US006318610B1

(12) United States Patent
Doherty

(10) Patent No.: US 6,318,610 B1
(45) **Date of Patent: *Nov. 20, 2001**

(54) WAIST MOUNTED ACCESSORY HOLDER

(76) Inventor: William Doherty, 11 Lakeshore Dr., Rancho Mirage, CA (US) 92270

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/988,058

(22) Filed: Dec. 10, 1997

Related U.S. Application Data

(60) Provisional application No. 60/033,296, filed on Dec. 10, 1996.

(51) Int. Cl.[7] ..... A45F 5/00

(52) U.S. Cl. ..... 224/271; 224/269; 24/3.6; 24/3.12

(58) Field of Search ..... 224/271, 272, 224/191, 269, 242, 245, 249, 255, 196, 197, 163, 250; 24/3.1, 3.6, 326

(56) References Cited

U.S. PATENT DOCUMENTS

| | | | | |
|---|---|---|---|---|
| 2,071,757 | * | 2/1937 | Matthews | 24/3.6 X |
| 2,465,328 | * | 3/1949 | Modrey | 24/3.6 |
| 3,659,759 | * | 5/1972 | Walton | 24/3.6 X |
| 4,363,432 | * | 12/1982 | Warthen | 224/666 X |
| 4,762,257 | * | 8/1988 | Spillers et al. | 224/250 |
| 5,106,004 | * | 4/1992 | Nguyen | 224/163 |
| 5,331,721 | * | 7/1994 | Raum, Sr. | 224/269 X |
| 5,363,680 | * | 11/1994 | Wu | 24/3.6 |
| 5,460,346 | * | 10/1995 | Hirsch | 224/272 |
| 5,604,958 | * | 2/1997 | Anscher | 224/272 |
| 5,620,120 | * | 4/1997 | Tien | 224/271 |
| 5,622,296 | * | 4/1997 | Pirhonen et al. | 224/272 X |

FOREIGN PATENT DOCUMENTS

| | | | | |
|---|---|---|---|---|
| 44934 A1 | * | 2/1982 | (EP) | 24/3.6 |
| 95593 A2 | * | 12/1983 | (EP) | 24/3.6 |
| 2081076 A | * | 2/1982 | (GB) | 24/3.6 |
| 2262879 A | * | 7/1993 | (GB) | 24/3.6 |

* cited by examiner

*Primary Examiner*—Gregory M. Vidovich

(57) ABSTRACT

An accessory holder that is to be used in such a way to securely hold ones accessories like keys (40), cameras (44), cellular phones, pagers, tape measures, and hand drills when they are not in use and to allow the person quick access to these accessories when they are needed. The preferred embodiment uses a modified seat belt buckle to carry A set of keys (40). Female end (25) is attached to the users belt (32) bag, or other convenient location. Male end (24) is attached to the accessory. When the accessory is needed, the user pushes button (26), and the accessory falls into the users hand. To return the accessory to female end (25), male end (24) must be inserted into opening (36). Male end (24) is pushed over the spring loaded locking mechanism and a distinctive "click" is heard once male end (24) is locked in place. The accessory can be conveniently carried in female end (25) until next time it is needed.

6 Claims, 7 Drawing Sheets

32
34
30
25
26
24A
38
40
36

WAIST MOUNTED ACCESSORY HOLDER

Background—Cross References to Related Applications

This invention was first submitted to the PTO as a provisional Patent Application.

Provisional Application Number: 601033,296

Filing Date: Dec. 10, 1996

Name of Applicant: William Doherty

Title of Invention: Waist Mounted Accessory Holder

BACKGROUND—FIELD OF INVENTION

This invention relates to a device that is used to carry commonly used accessories like keys, cameras, cellular phones, pagers, tape measures, and hand drills around a person's waist.

BACKGROUND—DESCRIPTION OF PRIOR ART

There are many medium sized accessories that people like to carry around. Items like keys, cameras, cellular phones, pagers, tape measures, and hand drills are usually carried so that they can be used in the near future. People want to carry these items with the least amount of inconvenience while still having their hands free to do other tasks. It is also important that these items are within easy reach when they are needed.

These accessories are frequently too large to fit into the front or rear pockets of a persons pants, so they need another way to be carried. The items can be placed in a jacket, vest, backpack, or fannypack. These solutions are inadequate for two reasons. Firstly, they require that the carrier wears another piece of clothing. Secondly, these solutions make it hard to get at the accessories when they are needed. The carrier will have to open up pockets, possible zipped or buttoned shut, and rummage for items when they are needed. This can be a waste of time and a major inconvenience if the item is used frequently.

Another solution is to carry the accessories in a hand held bag such as a briefcase, purse, handbag, or duffel bag. This solution is also inadequate for two reasons. Firstly, this requires that the person ties up one of his/her hands to carry the bag, which doesn't leave both hands free to do other tasks. Secondly, it takes time and energy to get one of these items out of the bag. It is an inconvenience to rummage through a bag every time a beeper goes off or every time you need to use one of your keys.

There have been a number of inventions that allow people to carry these items on their waists. U.S. Pat. No. 5,123,580 to Lee (1992) discloses a key holder that wraps around a persons belt. This device is designed to snap closed around a persons belt and hold all of his/her keys around ones waist. The problem with this design becomes apparent when the wearer wants to use his/her keys. The entire device has to be unsnapped and removed from the belt so that the keys can be used. Then the belt must be loosened or removed in order to get the piece of material around the belt so that the key holder can be refastened. This becomes time consuming if the keys are frequently used. It also becomes embarrassing if the keys are used in public, because it is not socially acceptable for a man or woman to loosen or remove his/her belt in public every time keys are to be used. This key holder is limited by the fact that it is only designed to carry keys and none of the other commonly used accessories I mentioned.

There have been other attempts to make devices that hold keys or tools around a persons belt. U.S. Pat. No. 4,107,823 to Siesto (1978) discloses a thin piece of sheet metal that is bent in such a way that it wraps around a persons belt and holds keys or other tools in place. Firstly, this is a narrow piece of sheet metal that is designed to hold a few keys. This device is too thin to effectively hold a device as large and heavy as an industrial tape measure or hand held drill. The narrow aspect of the design will disperse the weight of the tool over a small area of the belt, resulting in greater force per area. This will give added wear to a users belt and will eventually destroy the belts by forcing the sheet metal into the belt.

In this design an opening must be made between the two pieces of sheet metal before the key ring can be inserted. This means that the user must use two hands. One to make the opening and the other to slot the key ring between the two pieces of metal.

Removing the keys from this device presents another problem. The user has to fight gravity by lifting the keys higher than the mid point of the device before then can be removed. This action will require extra energy and becomes a greater design flaw when larger accessories are carried in the device.

This design also uses a key ring as the part of the tool that is connected to the belt clip. A key ring is a small round object that is difficult to handle. For this reason people have historically purchased novelty key chains to make their keys easier to handle. It is not easy for people to manipulate a small key ring onto this belt clip and it will be even more difficult for people who have either large hands or small key rings. This design flaw also makes this device very hard to use for people who have lost their hand dexterity and strength due to illness or old age.

The other flaw with this design is that it looks very utilitarian. It is just a simple piece of small sheet metal. This may be fine on the construction site but it wouldn't go over well with presentation conscious shoppers. This device would not look correct if worn by a tourist to carry his/her camera around Paris snapping occasional pictures of cafes and the Eiffel Tower. This device would also look out of place carrying a cellular phone and a beeper for a top level executive. This device also has no room or way of being customized with a corporate logo as to become part of a companies official uniform. I believe that it is important for accessory holders to look professional and stylish enough to be worn in all situations.

Some pagers, tape measures, and cellular phones are coming with clips on the back so that they can be worn on a persons belt. These clips are made out of plastic or metal depending on the manufacturer and they are designed to be both functional and visually appealing. The major problem with these designs is that every time you want to use one of these items you have to remove the whole thing from your belt. These can be difficult to remove if your belt is tight and even more difficult to return to your belt once the item has been used. This type of design also adds significant wear and tear to a belt by the repeated removal and installation of the clip.

OBJECTS AND ADVANTAGES

Accordingly, several objects and advantages of my patent are:

(a) to provide a way to carry accessories that doesn't require extra clothing and leaves both hands free;

(b) to provide a way to carry accessories so that they are always exposed and immediately ready for use;

(c) to provide a way to carry accessories that doesn't require the carrier to rummage through bags or pockets for the accessories once they are needed, (d) to provide a way to carry accessories by mounting them on a persons belt, waist, or other place that makes them easily accessible, (e) to provide a way to carry accessories that vary in size;

(f) to provide a way to carry accessories in such a way that they lock into place and are securely held;

(g) to provide a way to carry accessories that makes it easy for a person to remove, use, and return the accessory to the holder with the use of a single hand;

(h) to provide a way to carry accessories that will last for many years without need of repair or replacement;

(i) to provide a way to carry accessories using a modular design that will allow many accessories (like keys, cameras, cellular phones, pagers, tape measures, and hand held drills) to be held by the same carrier, (j) to provide a way to carry accessories that can easily be enhanced with a design or logo, which will make the accessory holder more appealing to customers who want to make a statement and company owners who want to use the holder as part of an official uniform;

(k) to provide a way to carry accessories that will make a clearly audible sound when they are securely locked into the accessory holder; and (l) to provide a way to carry accessories that makes it easy for the user to get the accessory when he/she needs it but makes it hard for the accessory to be accidentally removed and lost.

Further objects and advantages are to provide a waist mounted accessory holder that is inexpensive to manufacture and customize with new logos and artwork, It will be made of a sturdy and stylish construction that will stay functional and fashionable for many years. It will be easy to use and will provide a safe and convenient way to carry many different types of accessories like keys, cameras, cellular phones, pagers, tape measures, and hand drills.

Figure 1:
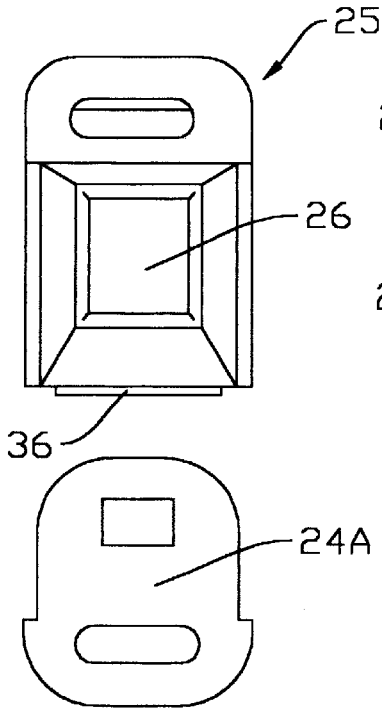
FIG. 1 shows a front view of a waist mounted accessory holder with a male end removed.

| Reference numbers in Drawings | | |
|---|---|---|
| 24A, 24B, 24C, 24D, 24E | Male End | 25 Female End |
| | 26 Button | 28 Clip |
| | 30 Quick-Link | 32 Belt |
| | 34 Belt Loop | 36 Opening in Female End |
| | 38 Key Ring | 40 Key |
| | 42 Oval Cuff | 44 Camera |

DETAILED DESCRIPTION AND OPERATION

A waist mounted accessory holder, as shown in FIGS. 1 to 13, is comprised of a male and female end. Female end (25) is attached to the users belt (32), belt loop (34), bag, or other place so that it is easily accessible. Male end (24A) is attached to an accessory like keys (40), cameras (44), cellular phones, pagers, tape measures, and hand drills. Male end (24A) is inserted into opening (36) in female end (25) and locked in place when the accessory isn't being used. When the accessory is to be used button (26) is depressed and male end (24A) and attached accessory are released and ready for use.

Figure 2:
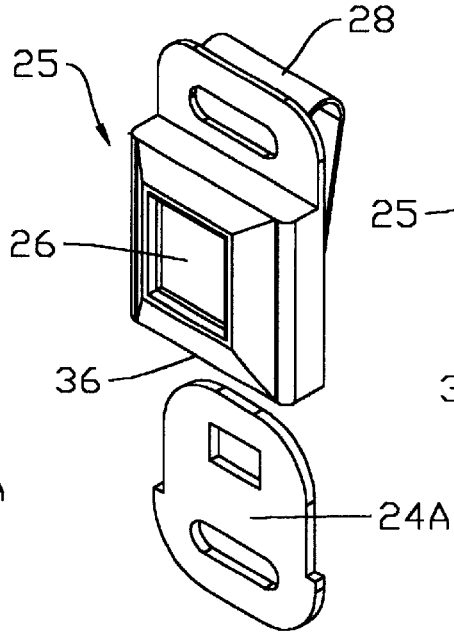
FIG. 2 shows an isometric view of a waist mounted accessory holder with a male end removed.
Figure 3:
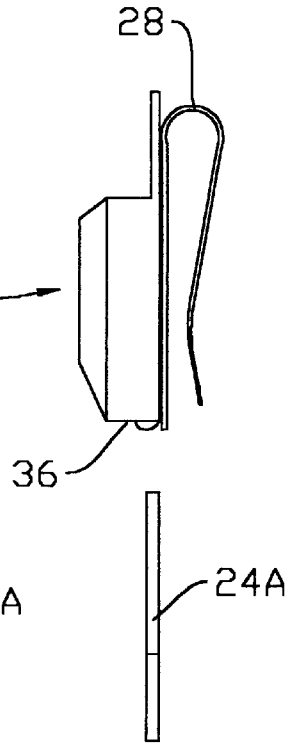
FIG. 3 shows a side view of a waist mounted accessory holder with a male end removed.

Referring to FIGS. 1 to 3 it can be seen that female end (25) is a seat belt buckle. This buckle has been used in most American built cars and truck over the last 25 years. It has been used extensively by both Ford and General Motors, It is most commonly seen with the GM, Cadillac, or Ford logo on the button depending on which car or truck it was intended. It is a metal component that has a thumb sized button (26) in the middle and an opening (36) on the bottom. Male end (24A) was also designed and manufactured to be used as part of the seat belt.

In this embodiment, refer to FIGS. 1 to 3, it can be seen that clip (28) was fixed to the back of female end (25). Clip (28) can be fixed with either double sided tape or two part epoxy. Clip (28) has been made out of a piece of one and a quarter inch wide stainless steel sheet metal. Clip (28) was made this wide to give it a large bonding area for the double sided tape and a large area for grasping belt (32). This width covers a large portion of the back of female end (25) without hanging over the edges. Clip (28) was made out of stainless steel in order to give it strength, corrosion resistance, and to cosmetically match the metallic finish of female end (25). The stainless steel has enough spring to allow clip (28) to open up once it is slid over a belt and to hold onto belt (32)

using this spring force. This allows clip (28) to correctly fit many belts of varying thickness.

Figures 4, 5, 6:
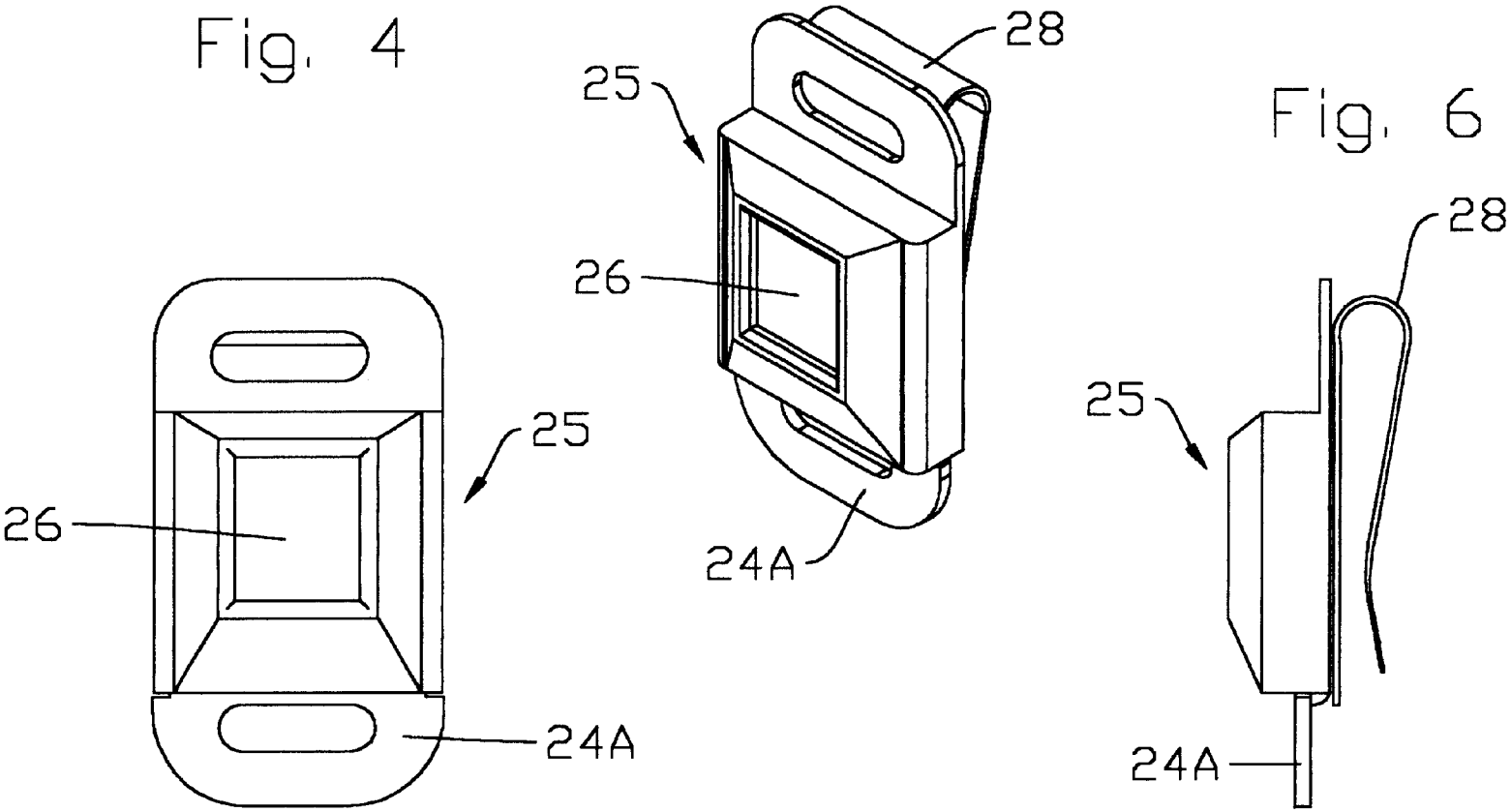
FIG. 4 shows a front view of a waist mounted accessory holder with a male end inserted.
FIG. 5 shows an isometric view of a waist mounted accessory holder with a male end inserted.
FIG. 6 shows a side view of a waist mounted accessory holder with a male end inserted.

FIGS. 1 to 3 show three views of female end (25) with clip (28) and male end (24A) below opening (36). FIGS. 4 to 6 show the same components but this time male end (24A) has been inserted into opening (36) in female end (25).

Figure 13:
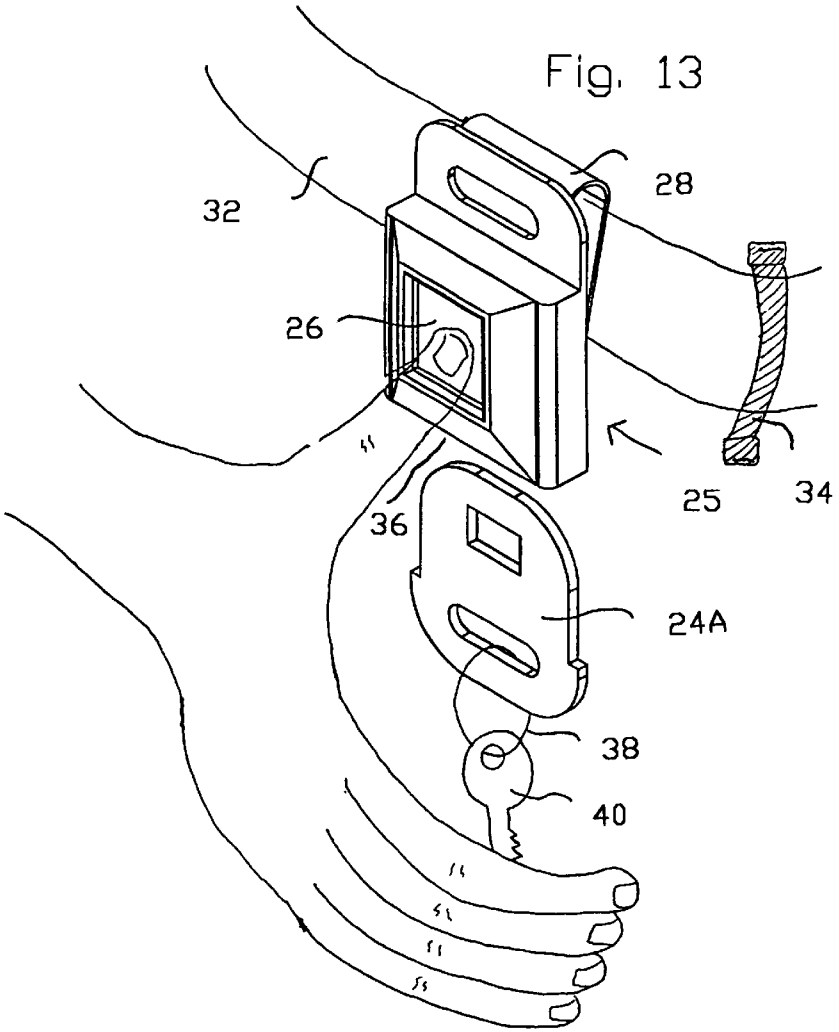
FIG. 13 shows an isometric view of a person using a waist mounted accessory lease a male end.

FIG. 13 shows this embodiment being used. Clip (28) has been slipped over belt (32) and the spring force of the clip is keeping female end (25) securely mounted to belt (32). The user has decided to use keys (40), so he/she pushes in button (26) and release the locking mechanism. Male end (24A) is no longer locked into female end (25) and gravity causes keys (40), key ring (38), and male end (24A) to fall into his/her hand.

Once he/she is finished using keys (40), they will grasp the easy to handle male end and push it into the opening (36) in female end (25). Male end (24A) will push through the spring loaded locking mechanism and lock into place with a distinctive audible "click". This "click" lets the user know that his/her keys (40) are safely held by female end (25), which is securely mounted to his/her belt.

Figure 7:
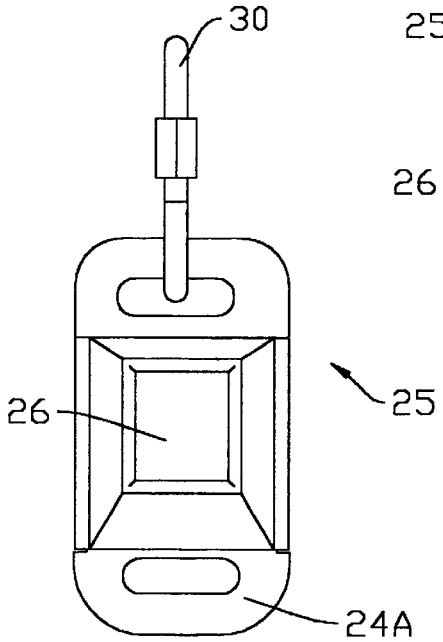
FIG. 7 shows a front view of another version of a waist mounted accessory holder with a male end inserted.
Figure 8:
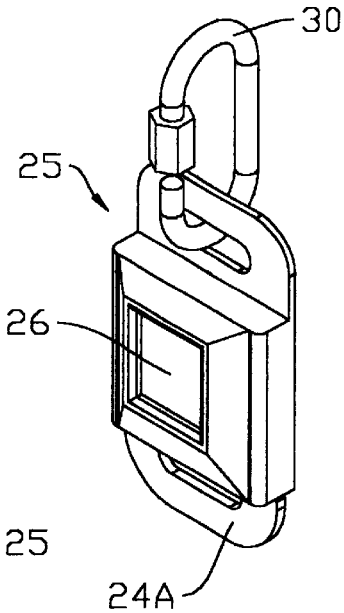
FIG. 8 shows an isometric view of a waist mounted accessory holder with a male end inserted as shown in FIG. 7.
Figure 9:
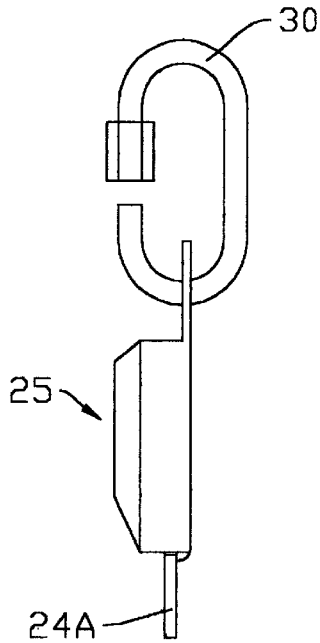
FIG. 9 shows a side view of a waist mounted accessory holder with a male end inserted as shown in FIG. 7.

FIGS. 7 to 9 show another embodiment of my invention. In this embodiment female end (25) is shown with Quick-Link (30) going through the oval opening at the top of female end (25). Quick-Links (30) are sold in most hardware stores and are designed to be used as a removable link in a chain. Quick-Links (30) are shaped like a normal link in a chain but one of the flat sides is open and threaded on each side of the opening. A hexagonal coupling, that is threaded on the inside, is placed on one of the threaded ends. By turning the hexagonal coupling you can open and close that side of the link.

Figures 10, 11, 12:
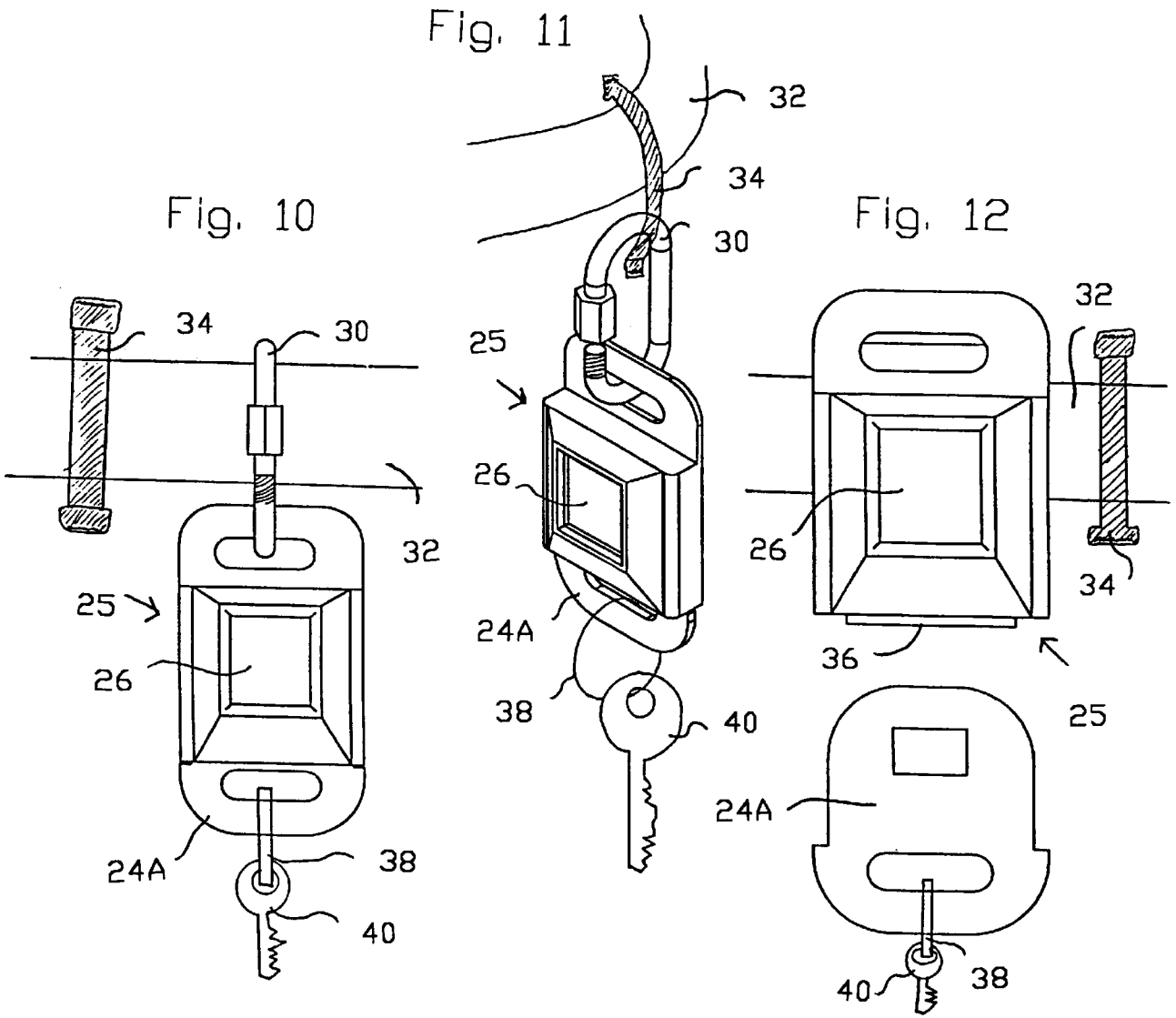
FIG. 10 shows a front view of a version of a waist mounted accessory holder looped through a belt with a male end inserted.
FIG. 11 shows an isometric view of a waist mounted accessory holder looped through a belt loop with a male end inserted.
FIG. 12 shows a front view of a waist mounted accessory holder clipped onto a belt end removed.

FIGS. 7 to 9 show that Quick-Link (30) was opened and fed through the oval opening at the top of female end (25). FIGS. 10 and 11 show two different ways I used Quick-Link (30) to attach female end (25) to the users waist. FIG. 10 shows belt (32) threaded through Quick-Link (30). This embodiment of my waist mounted accessory holder makes it impossible for female end (25) to be removed from the users waist unless belt (32) or Quick-Link (30) break. FIG. 11 shows Quick-Link (30) threaded through belt loop (34). FIGS. 10 and 11 show that the Quick-Link method of fastening female end (25) to users pants can work if the users does or doesn't decide to wear a belt. The Quick-Link embodiment also gives the user an extra degree of security. There is no way for female end (25) to be removed from the users waist without breaking either belt (32), belt loop (34), or Quick-Link (30).

Figure 19:
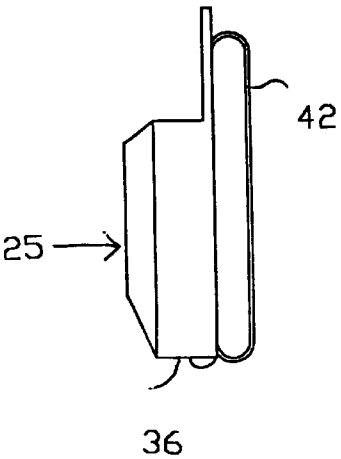
FIG. 19 shows a side view of a waist mounted accessory holder without a male end.

FIG. 19 shows another embodiment of my waist mounted accessory holder. FIG. 19 shows the same piece of stainless steel sheet metal used to make clip (28) bent into the shape of an oval cuff (42). Oval cuff (42) is mounted to the back of female end (25) using double sided tape or two part epoxy. This embodiment of the design forces the user to thread his/her belt through oval cuff (42). Once belt (32) is threaded through oval cuff (42) and fastened there is no way to remove female end (25) from the users waist without breaking either belt(32) or oval cuff (42). This embodiment looks stylish because oval cuff (42) can't be seen when female end (25) is viewed from the front.

Figure 14:
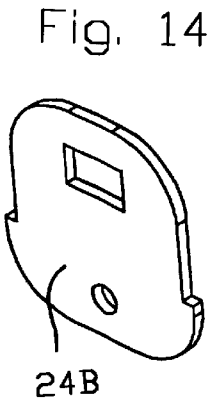
FIG. 14 shows a male end with one circular hole.
Figure 15:
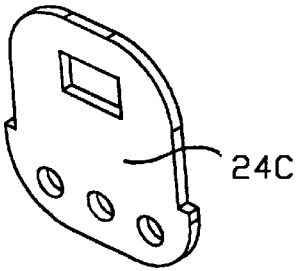
FIG. 15 shows a male end with three circular holes.
Figure 16:
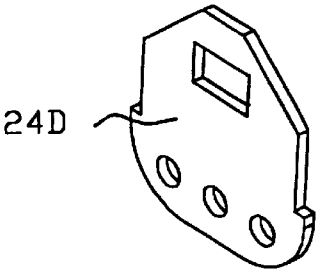
FIG. 16 shows a male end with ramped leading edges

FIGS. 14 to 16 show three different embodiments of male end (24A). FIG. 14 shows male end (24B) with one small hole in the bottom center. This hole can be used to hold a single key ring. FIG. 15 shows male end (24C) with three small holes. These holes can be used to separate three different key rings. The user can place house keys in hole 1, work keys in hole 2, and car keys in hole 3. This allows the user to easily find the key he/she is looking for.

FIG. 16 shows male end (24D) with a ramped top. This embodiment helps line up male and female ends when they are being locked together. If male end (24D) is placed off center into opening (36), then the ramps will contact the side of opening (36) and align male end (24D) in center of opening (36).

Figure 17:
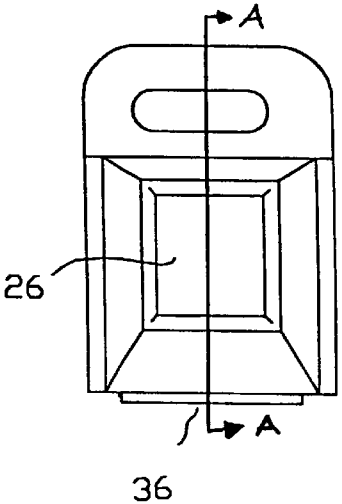
FIG. 17 shows a front view of a waist mounted accessory holder without a male end.
Figure 18:
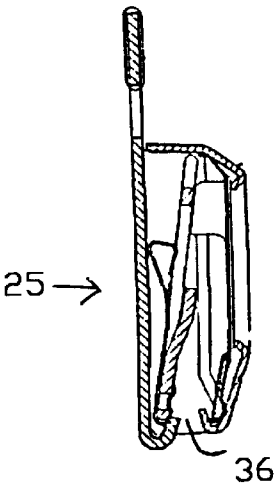
FIG. 18 shows section A—A in FIG. 17.

FIGS. 17 and 18 show a cross section through the middle of female end (25). This cross section shows the spring loaded locking mechanism that has been used in the seat belts of many American cars produced over the last 25 years. Since this is just one embodiment of my waist mounted accessory holder, I don't want to go into a detailed description of the internals of the seat belt buckle.

Figure 21:
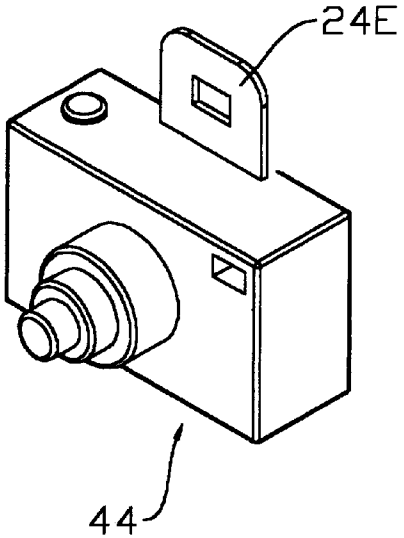
FIG. 21 shows an isometric view of a camera attached to a male end.
Figure 22:
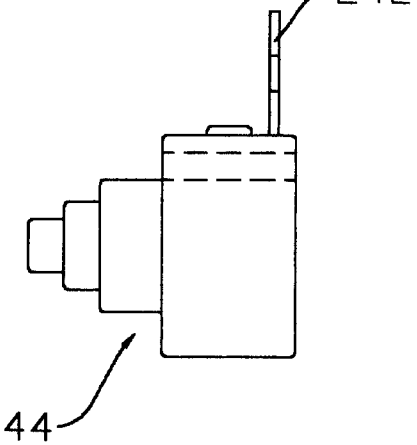
FIG. 22 shows a side view of a camera attached to a male end.
Figure 20:
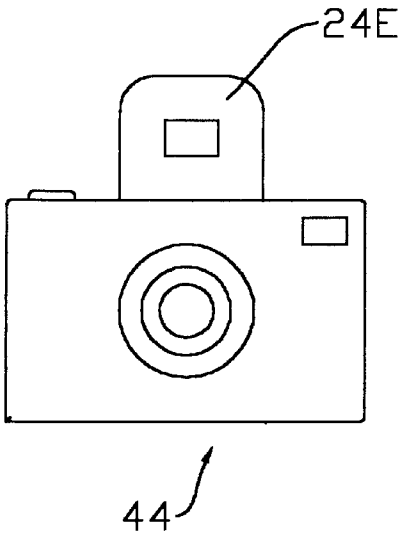
FIG. 20 shows a front view of a camera attached to a male end.

FIGS. 20 to 22 show how male end (24E) can attach to accessories such as camera (44). FIG. 20 is a front view of camera (44) that has male end (24E) sticking straight up. FIG. 21 is an isometric view of camera (44) and FIG. 22 is a side view of camera (44). FIGS. 20 to 22 show that male end (24E) can be made as part of camera (44). The manufactures and designers of camera (44) can decide to add a male end (24E) to their product so that it will be purchased by people who already have female end (25). If camera (44) is made of strong plastic then male end (24E) can be part of the camera mold. This would ensure that male end (24E) matches the style, color, and material of camera (44). If male end (24E) is not made as part of camera (44), then a male end can be designed that can be securely mounted to camera (44).

In the embodiment of my waist mounted accessory holder that uses a seat belt buckle, there are many advantages. The seat belt buckle has been tested for many years and the design has held up exceptionally well. The metals that are used are very corrosion resistant and look like new after more than 10 years of use. The locking mechanism is designed to be used over ten thousand times without need of maintenance or repair. The seat belt buckle is also designed to stay locked in case of an auto accident. This gives me confidence that the locking mechanism will be strong enough to easily carry any accessories. The American auto manufactures have made millions of these seat belt buckles and they have left the design the same for over 25 years. This tells me that the male and female end of a seat belt buckle are built strong enough to last for many years.

The seat belt buckle embodiment of my invention looks very good around a persons waist. The female end has a nice finish. It is made of shiny metal that doesn't loose it's luster for many years. The buckle is just the right size to look balanced no matter what accessory is carried. It is small enough to look great with just a few keys and large enough not to get over shadowed by a hand drill. It has a classic style that has not needed to be changed for 25 years. This timeless look of quality will make this accessory holder equally at home on the construction site as it is in the corporate boardroom.

The seat belt buckle also has a logo on the button. This feature will make this accessory holder even more appealing to consumers. A company logo like UPS, Home Depot, or Vons can be placed on the button and then the accessory holders can be issued as part of the corporate uniform. The corporate logo's can also be used to manufacture accessory holders that corporations want to distribute to their consumers as promotional gifts. The button can also be covered with a novelty saying or picture that will allow it to target a specific group of the population like bird watchers or motorcycle racers. The thumb sized logo in the middle of the accessory holder allows for far more marketing opportunities.

The seat belt embodiment of the waist mounted accessory holder is modular. This means that female end (25) stays the same no matter what accessory is being used. A person can use female end (25) to carry their keys (40) to work and once they get to work they can leave their keys on their desk and insert their camera (44) into female end (25). At the end of the day they can replace the camera (44) with the keys (40). This will make it possible for the user to only purchase one female end (25) and then they will have a selection of accessories they can use with that female end (25). This modular idea will be like the battery powered hand tools that all use the same batteries. The modular concept is beneficial because the user doesn't have to worry about a which female end (25) he/she will need to bring to work in order to carry around the cellular phone.

The pictures and descriptions of the waist mounted accessory holder show that there is a stylish, practical, and safe way to carry around accessories. The embodiment of this invention that uses a car seat buckle has numerous advantages in that 1) it permits the user to carry frequently used accessories without wearing extra clothing or tying up ones hands;
2) it permits the accessories to be located on the waist, where they can be rapidly accessed;
3) it permits the user to return the accessory to the female end with one hand;
4) it provides a male end with a rounded or ramped top that helps it automatically align with the opening in the female end,
5) it provides a recessed button that is easy for a thumb to find without the aid of sight,
6) it provides a recessed button that prevents accidental releases of the locking mechanism when the user bumps into walls, people, or other objects,
7) it permits a picture, logo, or saying to be placed on the button to make the device more appealing to a larger group of people;
8) it permits many different accessories to be used with the same female end;
9) it produces a distinctive "click" sound when the male end is locked in place, which allows the user to know that the accessory is safely placed without having to look;
10) it has a timeless look of quality that is equally well matched with blue jeans or a three piece suit;
11) it will gives years of maintenance free use and the finish will not tarnish; and
12) it will make the accessories very easy to remove from the female end because gravity will guide the accessories into the users hand once the button has been depressed.

The pictures and description I have included in this application talk specifically about one embodiment of my invention that uses a modified seat belt buckle to hold accessories conveniently around ones waist. I included a few different ways of attaching the female end to a persons waist and I also included a few different designs for a male end. These were some of the preferred embodiments of my invention but they should by no means be thought as of the only embodiments. The female end doesn't have to be a seat belt buckle. It could be a newly designed case that uses a different style of locking mechanism and a very different male end. The male end could be shaped as a pyramid or a hexagonal shaft. These ideas are presented to show how that my claims will encompass a much broader view of waist mounted accessory holders. The claims that follow should be used to determine the scope of my invention.

What is claimed is:

1. An apparatus for mounting keys to a belt comprising;

a substantially U-shaped clip having an inner surface and an outer surface, adapted to engage with said belt at said inner surface;

a female buckle component comprising a housing with a back side fixedly attached to said outer surface of said U-shaped clip, a face having a recessed aperture for a button, and a bottom side having a bottom aperture for receiving a male buckle component, a locking mechanism secured within said housing and adapted to engage with said male buckle component when said male buckle component is inserted in said bottom aperture, and a button cooperatively mated with said locking mechanism to guide said locking mechanism to an unlocked position when depressed, said button substantially aligned with said recessed aperture in said face; and a male buckle component having a locking portion for engaging with said locking mechanism when said male buckle component is inserted in said bottom aperture, and having a hole disposed therein for receiving one or more key rings, said hole being accessible when said locking portion is engaged with said locking mechanism.

2. The apparatus for mounting keys to a belt as claimed in claim 1 wherein said U-shaped clip is comprised of stainless steel.

3. The apparatus for mounting keys to a belt as claimed in claim 1 wherein said male buckle component includes one or more additional holes disposed therein for receiving one or more additional key rings.

4. The apparatus for mounting keys to a belt as claimed in claim 1 wherein said male buckle component includes a ramped top to aid in aligning said male buckle component with said bottom aperture.

5. An apparatus for mounting keys to a belt comprising:

clip means for engaging with said belt;

a female buckle component comprising a housing with a back side fixedly attached to said clip means, a face having a recessed aperture for a button, and a bottom side having a bottom aperture for receiving a male buckle component, a locking mechanism secured within said housing and adapted to engage with said male buckle component when said male buckle component is inserted in said bottom aperture, and a button cooperatively mated with said locking mechanism to guide said locking mechanism to an unlocked position when depressed, said button substantially aligned with said recessed aperture in said face; and said male buckle component having a locking portion for engaging with said locking mechanism when said male buckle component is inserted in said bottom aperture, and a having a hole disposed therein for receiving one or more key rings, said hole positioned external to said housing when said locking portion is engaged with said locking mechanism.

6. An apparatus for mounting keys to a belt comprising:

rigid oval cuff means for engaging with said belt;

a female buckle component comprising a housing with a back side fixedly attached to said cuff means, a face having a recessed aperture for a button, and a bottom side having a bottom aperture for receiving a male buckle component, a locking mechanism secured within said housing and adapted to engage with said male buckle component when said male buckle component is inserted in said bottom aperture, and a button cooperatively mated with said locking mechanism to guide said locking mechanism to an unlocked position when depressed, said button substantially aligned with said recessed aperture in said face; and said male buckle component having a locking portion for engaging with said locking mechanism when said male buckle component is inserted in said bottom aperture, and a having a hole disposed therein for receiving one or more key rings, said hole positioned external to said housing when said locking portion is engaged with said locking mechanism.

* * * * *